US007141538B2

(12) United States Patent
Noguchi et al.

(10) Patent No.: US 7,141,538 B2
(45) Date of Patent: Nov. 28, 2006

(54) LIQUID DETERGENT COMPOSITION

(75) Inventors: Toshiharu Noguchi, Wakayama (JP); Junya Hanai, Wakayama (JP); Kazunori Tsukuda, Wakayama (JP); Mitsuru Uno, Wakayama (JP)

(73) Assignee: Kao Corporation, Tokyo (JP)

( * ) Notice: Subject to any disclaimer, the term of this patent is extended or adjusted under 35 U.S.C. 154(b) by 254 days.

(21) Appl. No.: 10/819,317

(22) Filed: Apr. 7, 2004

(65) Prior Publication Data

US 2005/0003989 A1 Jan. 6, 2005

(30) Foreign Application Priority Data

Apr. 8, 2003 (JP) ..... 2003-104476
Apr. 17, 2003 (JP) ..... 2003-113280
Aug. 20, 2003 (JP) ..... 2003-208029

(51) Int. Cl.
*C11D 1/68* (2006.01)
*C11D 3/16* (2006.01)
*C11D 3/43* (2006.01)
*C11D 3/22* (2006.01)

(52) U.S. Cl. ..... 510/506; 510/182; 510/191; 510/197; 510/199; 510/238; 510/239; 510/240; 510/417; 510/421; 510/432; 510/527

(58) Field of Classification Search ..... 510/182, 510/191, 197, 199, 238, 239, 240, 417, 421, 510/432, 506, 527
See application file for complete search history.

(56) References Cited

U.S. PATENT DOCUMENTS

| | | | |
|---|---|---|---|
| 3,427,248 | A | 2/1969 | Lamberti et al. |
| 4,430,237 | A | 2/1984 | Pierce et al. |
| 5,494,611 | A | 2/1996 | Howe |
| 5,736,574 | A | 4/1998 | Burnier et al. |
| 5,750,487 | A | 5/1998 | Oldenhove et al. |
| 6,221,822 | B1 | 4/2001 | Crutcher et al. |
| 2004/0023834 | A1* | 2/2004 | Inoue et al. ..... 510/421 |

FOREIGN PATENT DOCUMENTS

| | | | |
|---|---|---|---|
| EP | 1092761 | A2 | 4/2001 |
| EP | 1226814 | A1 | 7/2002 |
| EP | 1365013 | A1 * | 11/2003 |
| EP | 1405669 | A2 | 4/2004 |
| JP | 57-133200 | A | 8/1982 |
| JP | 64-67235 | A | 3/1989 |
| JP | 2-32197 | A | 2/1990 |
| JP | 2-182793 | A | 7/1990 |
| JP | 3-269097 | A | 11/1991 |
| JP | 5-279699 | A | 10/1993 |
| JP | 5-320694 | A | 12/1993 |
| JP | 6-306400 | A | 11/1994 |
| JP | 6-336598 | A | 12/1994 |
| JP | 7-3289 | A | 1/1995 |
| JP | 7-310099 | A | 11/1995 |
| JP | 9-59695 | A | 3/1997 |
| JP | 9-509438 | A | 9/1997 |
| JP | 9-310100 | A | 12/1997 |
| JP | 10-1698 | A | 1/1998 |
| JP | 11-189796 | A | 7/1999 |
| JP | 11-256200 | A | 9/1999 |
| JP | 2000-96086 | A | 4/2000 |
| JP | 2000-303095 | A | 10/2000 |
| JP | 2001-19999 | A | 1/2001 |
| JP | 2001-98296 | A | 4/2001 |
| JP | 2001-247449 | A | 9/2001 |
| JP | 2001-247899 | A | 9/2001 |
| JP | 2001-342500 | A | 12/2001 |
| WO | WO01/59059 | A1 | 8/2001 |

* cited by examiner

*Primary Examiner*—Brian P Mruk
(74) *Attorney, Agent, or Firm*—Oblon, Spivak, McClelland, Maier & Neustadt, P.C.

(57) ABSTRACT

The present invention relates to a liquid detergent composition containing (a) a specific compound having one alkyl group selected from a 2-ethylhexyl group, an isononyl group and an isodecyl group, (b) anionic surfactant having an alkyl or alkenyl group having 11 to 16 carbon atoms, (c) a hydrophobic organic solvent which is liquid at 20° C. and (d) water, wherein (c)/(d) and (c)+(d) are respectively in a specific range.

9 Claims, No Drawings

LIQUID DETERGENT COMPOSITION

This Nonprovisional application claims priority under 35 U.S.C. § 119(a) on Patent Application No(s) . 2003-104476; 2003-113280 and 2003-208029 filed in JAPAN on Apr. 8, 2003; Apr. 17, 2003 and Aug. 20, 2003, the entire contents of which are hereby incorporated by reference.

FIELD OF THE INVENTION

The present invention relates to a liquid detergent composition.

BACKGROUND OF THE INVENTION

Hydrophobic solvents such as terpene type hydrocarbons and paraffin are superior in the effect of washing out denatured oil and fats, grease and oil and therefore widely used for liquid detergents. For example, JP-A 2001-19999 discloses a water-dispersible detergent for removing oily stains, the detergent containing a terpene compound and a surfactant. JP-A 2001-98296, JP-A 2000-96086, JP-A 2000-303095, JP-A 10-1698, JP-A 6-336598, JP-A 5-279699 and JP-A (W) 9-509438 disclose detergents containing a terpene compound, wherein there is a description that a glycol ether type solvent is used at the same time in the sections entitled "Detailed Description of the invention" and "Claims". Detergents containing a terpene compound and a glycol solvent are disclosed in JP-A 2001-247449, JP-A 2001-342500, JP-A 7-310099 and JP-A 5-320694. Detergents containing a terpene type hydrocarbon and a nonionic surfactant are disclosed in JP-A 2001-247899, the publication of JP-A 9-59695 and JP-A 9-310100.

In the meantime, technologies utilizing a polyol type compound having an alkyl or alkylene chain as a detergent are known. As the polyol compound, alkyl glyceryl ether type compounds, sugar type compounds such as alkyl glycosides and fatty acid ester type compounds of (poly) glycerin are known. For example, as regards to the alkyl glyceryl ether type compounds, liquid detergents using a monoalkyl monoglyceryl ether having 7 or less carbon atoms are described in JP-A 7-3289. In JP-A 7-500861, there is a description that 50 mol % or more of glyceryl ether is a di-isomer, glyceryl ether having 12 to 18 carbon atoms is contained as a non-surfactant foaming retardant, a compound such as high-molecular weight hydrocarbons such as paraffin, fatty acid esters, fatty acid esters of monohydric alcohols and aliphatic C18–C40 ketones may be compounded though it is an optional component. Also, as the surfactant, nonionic surfactants are exemplified. In JP-A 11-189796, liquid detergents are described which exhibit more excellent detergency using monoalkyl monoglyceryl ethers having 1 to 11 carbon atoms by mixing a combination of those differing in the number of carbons or a combination of isomeric alkyls. In JP-A 11-256200, there is a description concerning a liquid detergent composition containing a monoglyceryl ether derivative having any one of an alkyl group having 1 to 12 carbon atoms, an alkenyl group having 1 to 12 carbon atoms, benzyl group and phenyl group, a terpene type hydrocarbon, a surfactant and a builder. With regard to liquid detergents containing glyceryl ether derivatives besides the above detergents, a detergent composition is described in JP-A 57-133200, the detergent composition being compounded of a monoalkyl monoglyceryl ether having a methyl-branched alkyl group and exhibiting excellent detergency to remove oil stains and sebum stains. Also, in U.S. Pat. No. 4,430,237, a detergent containing a monoalkyl (mono-, di- or tri-)glyceryl ether having 8 to 16 carbon atoms is described. The detergents disclosed in U.S. Pat. No. 3,427,248, JP-A 64-67235 and JP-A 5-502687 may be given as examples of detergents containing a polyol compound shown by a general formula including a glyceryl ether derivative.

Moreover, as to detergents containing an alkyl glycoside type compound, liquid detergents containing an alkyl glycoside type surfactant, a monoterpene or sesquiterpene type hydrocarbon and other components are described in JP-A 2-182793, JP-A 2-32197 and JP-A 3-269097.

As technologies to be remarked, WO01/059059 is exemplified. In this patent publication, there is a description as to a micro-emulsion type detergent composition containing (a) water, (b) (i) a C6–24 alcohol ethoxylate surfactant containing about 1 to 20 molecules of an ethylene oxide residue and (ii) a C6–24 alkyl polyglycoside surfactant having a degree of polymerization of about 1 to about 10 [(i):(ii) is about 1:4 to about 4:1 (weight ratio)] and (c) a hydrophobic oil.

EP-A 1365013 (distributed as of Nov. 26, 2003) discloses a liquid detergent composition containing a nonionic compound having an alkyl group, which is connected with an organic group having hydroxy groups through an ether bond, ester bond, amide bond or a nitrogen atom, a hydrophobic organic solvent and (d) water. WO-A 01/59059 discloses a microemulsion detergent composition containing an alcohol ethoxylate surfactant and an alkyl polyglycoside. JP-A 6-306400 discloses a near three-critical point detergent composition containing a polar solvent, a water-soluble or water-dispersible low molecular weight amphoteric material and non- or weak-polar solvent.

SUMMARY OF THE INVENTION

The present invention relates to a liquid detergent composition containing (a) a nonionic compound having one alkyl group selected from a 2-ethylhexyl group, an isononyl group and an isodecyl group, the alkyl group being connected with an organic group having 1 to 10 hydroxyl groups and 3 to 30 carbon atoms through an ether bond, an ester bond, an amide bond or a nitrogen atom, (b) a nonionic surfactant having an alkyl or alkenyl group having 11 to 16 carbon atoms, (c) a hydrophobic organic solvent which is liquid at 20° C. and (d) water, wherein (c)/(d)=0.5/99.5 to 40/60 (mass ratio) and (c)+(d)=50 to 99 (mass %).

DETAILED DESCRIPTION OF THE INVENTION

The present invention relates to a liquid detergent for preferably hard surface use which has high detergency to remove soap residue stains or denatured oil stains, is homogenous and has high stability.

Although not wanting to be limited by theory, it is believed that hydrophobic solvents are usually used in combination with a surfactant when used for aqueous liquid compositions because they are less affinitive to water. Among surfactants, nonionic surfactants are preferable from the viewpoint of emulsifying ability in a hydrophobic solvent in relation to stability problems, for example, particularly, separation and cloudiness. However, in a system using only a surfactant such as a general nonionic surfactant, a hydrophobic solvent is firmly incorporated into a structural body such as a micelle of the surfactant and there is therefore the problem that the high detergency which the hydrophobic solvent originally has is impaired so that the expected effects cannot be obtained in actual washing. Although nonionic surfactants are also effective surfactants for detergents, surface activity which is essential for surfactants is inevitably consumed for a hydrophobic solvent when the hydrophobic solvent is combined and a desired detergent effect cannot be therefore obtained. The foregoing WO01/059059 is to obtain high detergency to remove hydrophobic stains by using an oil which is a hydrophobic solvent. However, a microemulsion composed of the surfactant and oil used preferably in the prior art can exhibit only insufficient detergent effects.

Namely, there is a demand for a liquid detergent which has high detergency, is free from the problem of stability even when the content of the nonionic surfactant is decreased, does not damage the effect which a hydrophobic solvent originally has and also brings out both the detergent effects of a nonionic surfactant and a hydrophobic solvent.

The present invention relates to a liquid detergent composition containing a nonionic surfactant and a specific hydrophobic solvent, the composition having the characteristics that it has high detergency, is free from the problem on stability even when the content of the nonionic surfactant is decreased, does not damage the effect which a hydrophobic solvent originally has and also brings out both the detergent effects of a nonionic surfactant and a hydrophobic solvent.

<Component (a)>

Component (a) of the liquid detergent composition of the present invention is a compound having a tendency to orient towards the interface between water and the hydrophobic organic solvent which is Component (c) of the present invention. The difference between Component (a) and usual surfactants is considered to be that Component (a) is scarcely incorporated into Component (c) on the one hand and scarcely forms a micelle on the other due to the hydrophobic part which is constituted of a specific branched alkyl group and the hydrophilic part due to hydroxy groups is limited in number, with the result that the potential of Component (c), the hydrophobic solvent to remove oil stains is not lost.

Examples of Component (a) may include compounds (hereinafter referred to as "a1") represented by the following formula (1), polyoxyalkylene alkyl ether (hereinafter referred to as "a2") which have one alkyl group selected from a 2-ethylhexyl group, an isononyl group and an isodecyl group and in which the average addition mol number of alkylene oxides having 2 or 3 carbon atoms is 2 to 6 and compounds (hereinafter referred to as "a3") represented by the following formula (2).

$$R1—T—[S]m \quad (1)$$

In the formula, R1 represents an alkyl group selected from 2-ethylhexyl group, an isononyl group and an isodecyl group and T represents a group selected from —O—, —COO—, —OCO—, —CON< and —N<, provided that when T is —O—, —COO— or —OCO—, m is 1 whereas when T is;

—CON< or —N<, m is 2. S represents a group having 1 to 10 hydroxyl groups and having a total carbon number from 4 to 30, provided that when the number of hydroxyl groups in S is 1, m is 2 whereas when the number of hydroxyl groups in S is 2, at least one group is a hydroxy group bonded with an oxyethylene group or a polyoxyethylene group (average addition mol number: 5 or less and exceeding 1).

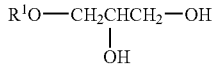

(2)

In the formula, $R^1$ is the same as above.

As to the alkyl group in Component (a), particularly, compounds having a 2-ethylhexyl group are preferable.

The alkyl group or R1 in Component (a) is preferably derived from a corresponding alcohol. Component (a) having an isodecyl group is preferably those obtained from isodecanol prepared by hydroformylating nonene by an oxo process, followed by hydrogenating. The isodecanol is a mixture of many isomers having a methyl branch at each position and the typical structure of isodecanol is 8-methyl-1-nonanol. Component (a) having an isononyl group is preferably those obtained from isononyl alcohol prepared by hydroformylating diisobutylene by an oxo process, followed by hydrogenating. The major component of the isononyl alcohol is 3,5,5-trimethyl-1-hexanol. Component (a) having a 2-ethylhexyl group is preferably those obtained from 2-ethyl-1-hexanol prepared by carrying out the aldol condensation of n-butylaldehyde, followed by hydrogenating.

Component (a1) will be hereinbelow described in detail.

In the case where S in formula (1) is a group derived from saccharides, Component (a1) tends to incorporate the hydrophobic organic solvent as Component (b) to form a firm O/W emulsion and therefore Component (b) is confined, with the result that there is a tendency that only insufficient detergency can be obtained. For this, the compound represented by formula (1) is more preferably those in which S is a group derived from materials other than saccharides.

Specific compounds represented by formula (1) may include compounds represented by the following formulae (1-1) to (1-4).

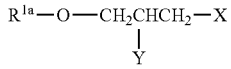

(1-1)

In the formula, R1a represents an alkyl group selected from 2-ethylhexyl group, an isononyl group and an isodecyl group, X and Y represent a hydroxy group or —O—CH2CH(V)CH2-W, provided that the case where X and Y are both hydroxy groups is excluded, where V and W respectively represent a hydroxy group or —O—CH2CH(V)CH2-W.

(1-2)

In the formula, R1a is the same as above, R1b and R1c respectively represent an ethylene group and/or a propylene group. m and n are respectively a number from 0 to 10 and preferably from 0 to 7, provided that the case where both are 0 is excluded. It is more preferable that the sum of m and n is 1 to 3.

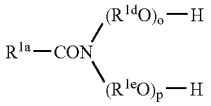

(1-3)

In the formula, R1a is the same as above, R1d and R1e respectively represent an alkylene or hydroxyalkylene group having 1 to 3 carbon atoms and o and p are respectively a number from 1 to 10.

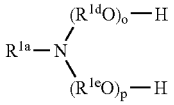

(1-4)

In the formula, R1a, R1b, R1e, o and p respectively have the same meaning as above.

The compound of formula (1-1) may be produced by reacting an alcohol compound represented by R1aOH with an epoxy compound such as epihalohydrin or glycidol by using an Lewis acid such as BF3. In this reaction, it is preferable to use an aluminum catalyst represented by formula (1-5) described in WO-A 98/50389 from an economical point of view and for the purpose of obtaining a desired detergent effect.

Al(OSO2-R1f)q(OR1g)r(OR1h)s (1-5)

In the formula, R1f represents a hydrocarbon group which may have a substituent, R1g and R1h, which may be the same or different, respectively represent a hydrocarbon group which may have a substituent. q is a number from 1 to 3, and r and s are respectively a number from 0 to 2 provided that q+r+s=3.

Here, R1f is preferably an alkyl group (preferably a methyl group) having 1 to 5 carbon atoms, a hydroxy group or an aryl group (preferably a 4-tolyl group or a 4-hydroxyphenyl group) which may have an alkyl group having 1 to 5 carbon atoms. Also, Rlg and Rlh are respectively preferably an alkyl group (e.g., an isopropyl group or an octyl group) having 1 to 10 carbon atoms or a phenyl group.

In the case of the above production using a catalyst, the epoxy compound is preferably used in excess of 1.5 to 5 mol equivalents to R1aOH to react with the view of obtaining the compound of formula (1-1) in high yield. However, compounds represented by formula (1-1) in which X and —OY are both hydroxy groups (hereinafter referred to as Component (a'))are also included. In the present invention, the ratio of Component (a') is preferably from 0.1 to 30mass %, more preferably from 0.1 to 20 mass %, even more preferably from 0.1 to 10 mass % and even more preferably 0.1 to 5 mass % based on Component (a) in view of obtaining the effect of the present invention. Operations such as distillation are carried out to attain the above defined content of Component (a').

The compound of formula (1-2) may be produced by adding ethylene oxide (hereinafter referred to as EO) and/or propylene oxide (hereinafter referred to as PO) and preferably EO, by using the usual method, to a compound R1a-O—CH2CH (OH) CH2—OH which can be manufactured in the same method as in the case of the compound of formula (1-1) (provided that the mol ratio of R1aOH to the epoxy compound is 0.8 to 1.5 and preferably 0.9 to 1.2).

In the compound of formula (1-3), —(R1dO)o-H and —(R1eO)p-H may be different from each other. Particularly, R1d and R1e are respectively an alkylene group having 2 or 3 carbon atoms and preferably an ethylene group and o and p are respectively from 1 to 10 and preferably 1 to 3.

The compound of formula (1-3) can be easily synthesized by running a dehydration reaction between fatty acid and ethanolamine and by adding an alkylene oxide to the resulting compound.

In the compound of formula (1-4), —(R1dO)o-H and —(R1eO)p-H may be different from each other. Particularly, it is preferable that R1d and R1e be each an ethylene group and o and p be a number from 1 to 3.

The compound of formula (1-4) may be obtained by adding an alkylene oxide to a primary amine having a long-chain alkyl group.

In the present invention, R1a in formulae (1-1) to (1-4) is an alkyl group selected from a 2-ethylhexyl group, an isononyl group and an isodecyl group and more preferably a 2-ethylhexyl group from the viewpoint of detergent effect and the stability of the composition. Among the compounds represented by formulae (1-1) to (1-4), at least one compound selected from the compounds represented by formulae (1-1) or (1-2) are more preferable and the compounds represented by formula (1-1) are even more preferable.

(a2) will be explained in detail. The alkylene oxide having 2 or 3 carbon atoms as Component (a2) is ethylene oxide (hereinafter referred to as EO) or propylene oxide (hereinafter referred to as PO). Because PO strengthens hydrophobic properties and the average addition mol number of PO is preferably from 0 to 2, a structure necessarily containing EO is preferable. In the present invention, compounds primarily containing EO are preferable and particularly compounds in which all the alkylene oxide groups are EOs are more preferable. The average addition mol number of alkylene oxides is from 2 to 6 mol and preferably from 2 to 5 mol.

Component (a2) having a 2-ethylhexyl group may be obtained by adding an alkylene oxide to 2-ethyl-1-hexanol obtained by aldol-condensing n-butylaldehyde, followed by hydrogenating.

Component (a2) having an isononyl group maybe obtained by adding an alkylene oxide to isononyl alcohol obtained by hydro-formylating diisobutylene by an oxo process, followed by hydrogenating. The isononyl alcohol contains 3,5,5-trimethyl-1-hexanol as its major component.

Component (a2) having an isodecyl group may be obtained by adding an alkylene oxide to isodecanol obtained by hydro-formylating nonene by an oxo process, followed by hydrogenating. Also, the isodecanol is a mixture of many isomers having a methyl branch at each position and the typical structure of the isodecanol is 8-methyl-1-nonanol.

As Component (a2) of the present invention, a polyethylene glycol-2-ethylhexyl ether (ethylene oxide average addition mol number=from 2 to 6) is preferable.

Next, (a3) will be described in detail. The compound of (a3) may be manufactured by reacting an alcohol compound represented by R1aOH with an epoxy compound such as epihalohydrin or glycidol by using a Lewis acid such as BF3. In this reaction, an aluminum catalyst described in WO-A 98/50389 may be used.

As R1OH in the present invention, 2-ethyl-1-hexanol is particularly preferable.

In the present invention, an epoxy compound such as epihalohydrin or glycidol is preferably added to the above R1OH by using the above catalyst. Generally, an epoxy compound is used in excess of 1 to 5 mol equivalents to R1OH to react. In this case, besides the compound of formula (2) polymers in which the epoxy compound is added to the compound of formula (2) are also produced. In the preferred embodiments of the present invention, the coexistence of polymers are not denied. However, it has been found that the amount of the polymers is preferably smaller provided that the mass ratio of (a)/(b) is in the range which will be described later for more preferable stabilizing conditions. Namely, the ratio of polymers/Component (a) (mass ratio) is adjusted to preferably 0.3 or less, more preferably 0.1 or less and even more preferably 0.05 or less. The regulation of the content of such polymers can be accomplished by a method using a catalyst as described in WO-A 98/50389 or a method in which refining operations such as distillation are carried out. Also, the mass ratio of these polymers can be found using gas chromatography.

When Component (a3) is compounded, the stabilizing method is slightly different from that of (a1) or (a2). Component (b) having good compatibility with Component (a3) is an alkylpolyglycoside type surfactant which will be explained later. In relation to stability, the ratio of Component (a3) is different from that of other Component (a)

Component (a) enables the hydrophobic solvent as Component (c) to disperse in an aqueous solution without changing the nature of the hydrophobic solvent.

In the present invention, Component (a) is preferably a nonionic compound selected from Components (a2) in view of stability and detergency.

<Component (b)>

Examples of Component (b) in the present invention may first include compounds (hereinafter referred to as Component (b1)) represented by the following formula (I).

R2a-A-[(R2bO)a-R2c]b (I)

In the formula, R2a represents an alkyl group having 11 to 16 and preferably 11 to 14 carbon atoms wherein a carbon atom connected with A is a primary carbon atom or a secondary carbon atom and a carbon chain connected with the carbon atom has no branched chain and R2b represents an alkylene group having 2 or 3 carbon atoms and preferably an ethylene group. R2c represents an alkyl group having 1 to 3 carbon atoms or a hydrogen atom. a denotes a number from 3 to 20, preferably 3 to 15, more preferably 5 to 15 and even more preferably 5 to 10. A represents —O—, —COO—;

—CON< or —N< provided that when A is —O— or —COO—, b is 1 whereas when A is;

—CON< or —N<, b is 1 or 2.

Specific examples of the compound of formula (I) may include compounds represented by the following formulae (I-1) to (I-4).

R2a-O—(C2H4O)c-H (I-1)

In the formula, R2a has the same meaning as above. c is a number from 3 to 20 and preferably 3 to 15.

R2a-O—(C2H4O)d-(C3H6O)e-H (I-2)

In the formula, R2a has the same meaning as above. d and e are respectively a number from 1 to 20 and preferably 3 to 15, and (C2H4O) and (C3H6O) may be a random or block adduct.

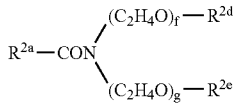

(I-3)

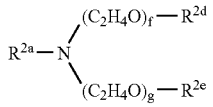

(I-4)

In the formula, R2a has the same meaning as above. f and g are respectively a number from 0 to 20 wherein f+g=0 to 20 and preferably 0 to 10. R2d and R2e respectively represent a hydrogen atom or an alkyl group having 1 to 3 carbon atoms.

Component (b1) in the present invention is preferably the compound represented by formula (I-1) and more preferably a polyoxyethylene alkyl ether which has a straight-chain $C_{11}$–$C_{16}$ alkyl group having a primary or secondary carbon atom connected with an oxygen atom and is provided with 3 to 20 mol, preferably 3 to 15 mol and more preferably 5 to 10 mol (in average) of EO added thereto from the viewpoint of, particularly, detergent effect and stability.

Specific examples of the straight-chain alkyl group R2a having a primary carbon atom connected with an oxygen atom and having 11 to 16 carbon atoms in formula (I-1) may include alkyl groups originated from a raw material straight-chain alcohol obtained from natural oil and fats such as coconut oil and palm oil and alkyl groups originated from a raw material alcohol obtained from a petroleum raw material type by an oxo process and having a small amount of branch (obtained by hydro-formylating 1-olefin having 10 to 14 carbon atoms), followed by hydrogenating. Alcohols produced by an oxo process are obtained as a mixture of straight-chain alcohols and branched primary alcohols in which a methyl group is branched at the βposition with respect to an alcohol hydroxy group. In the case of selecting an alcohol obtained by an oxo process as the raw material of the straight-chain alkyl group in (b1) used in the present invention, the content of a branched primary alcohol is preferably 30 mass % or less and more preferably 20 mass % or less).

As the compound represented by formula (I-1) and having the straight-chain alkyl group R2a having a primary carbon atom connected with an oxygen atom, for example, Kalcol 20(trademark), Kalcol 40(trademark), Kalcol 60(trademark) manufactured by Kao Corporation may be used. When an alcohol produced by an oxo process is used, Dovanol 23, Dovanol 25 and Dovanol 45 manufactured by Mitsubishi Chemical Co., Ltd. may be used.

As the compound represented by formula (I-1) and having the straight-chain alkyl group R2a having a secondary carbon atom connected with an oxygen atom, Softanol 33 (trademark), Softanol 50 (trademark), Softanol 70 (trademark) or Softanol 120 (trademark) manufactured by Nippon Shokubai Co., Ltd. may be used.

Specific other examples of Component (b) include compounds (hereinafter referred to as Component (b2)) represented by the following formula (II).

R3a-(OR3b)hGi (II)

In the formula, R3a represents a straight-chain alkyl group having 8 to 16 and preferably 9 to 14 carbon atoms, R3b represents an alkylene group having 2 to 4 carbon atoms, preferably an ethylene group or a propylene group and more preferably an ethylene group, G represents a residue derived from a reducing sugar, h is an average number from 0 to 6, preferably 0 to 3 and more preferably 0 and i is an average number from 1 to 3 and preferably from 1 to 2.

In formula (II), the carbon atom of R3a which is to be connected with an oxygen atom is preferably a primary carbon atom.

G is a residue derived from a reducing sugar. As the reducing sugar used as a raw material, either aldose or ketose may be used and examples of the sugar may include triose, tetrose, pentose and hexose having 3 to 6 carbon atoms. Specific examples of aldose may include apiose, arabinose, galactose, glucose, lychisose, mannose, gulose, aldose, idose, talose and xylose. Examples of a ketose may include fructose. Among these sugars in the present invention, aldopentose or aldohexose having 5 or 6 carbon atoms is preferable and especially glucose is more preferable.

The compound of formula (II) may be easily synthesized by running an acetalization reaction or a ketal-forming reaction between the above reducing sugar and R3a-(OR2b)h-OH by using an acid catalyst. In the case of the acetalization reaction, the compound of formula (II) may have either a hemiacetal structure or an ordinary acetal structure.

As Component (b) in the present invention, Component (b1) and (b2) are preferable from the viewpoint of detergency. Particularly, among the compounds represented by formula (I-1), polyoxyethylene alkyl ethers having a straight-chain alkyl group in which the carbon atom of R2a connected with A is a secondary carbon atom or alkyl polyglycosides having an average sugar condensation of 1.2 to 1.4 among the compounds of formula (II) are preferable from the viewpoint of detergent effect and stability.

In the case where Component (a) is Component (a3), Component (b2) is compounded as Component (b) taking the stability of the liquid detergent into account.

Component (b) enables the formation of a stable state without impairing the properties of Component (c) as a hydrophobic solvent even if the concentration of Component (a) to be compounded is small. Also, the use of Component (b) in combination with Component (a) makes it possible to restore the detergency of Component (c) itself which detergency is conventionally inhibited by micelle formation of Component (c), resulting in a situation where excellent detergency can be obtained.

<Component (c)>

The hydrophobic organic solvent liquid at 20° C. which is used in the present invention is an organic solvents having a solubility parameter (hereinafter referred to as sp value) of 10.0 to 21.0, preferably 14.0 to 21.0 and more preferably 14.0 to 19.0 which is found by the following equation which is usually well-known and a solubility of 0.5 mass % or less in 20° C. water. In this range, excellent detergency can be obtained. As the sp value is found, values described in Hoy, K. L., The Hoy Tables of Solubility Parameters, Union Carbaide Corporation, Solvents and Coatings Materials Division, South Charlston, W. Va. (1985) can be used.

$$\delta=(\Delta H/V)^{1/2}$$

where:

δ; Solubility parameter (sp value)[$(J/cm^3)^{1/2}$]

ΔH; Molar heat of vaporization

V; Molar volume

The hydrophobic organic solvent may have an ether group, amide group, ester group or the like if the sp value is in the above range. Examples of Component (c) may include hydrocarbons having a total carbon number of 6 to 30, monohydric aliphatic alcohols and their esters, other fatty acid esters and aliphatic ketones. In the present invention, it is preferable to use hydrocarbons having 8 to 20 and more preferably 8 to 15 carbon atoms.

Specific examples of the hydrocarbon may include olefinic hydrocarbons, paraffin type hydrocarbons, aromatic hydrocarbons and terpene type hydrocarbons.

As the olefinic hydrocarbon, a straight-chain olefin compound such as hexene, octene, decene, dodecene or tetradecene, a branched olefinic compound such as diisobutylene or triisobutylene or cyclic olefinic compound such as cyclohexene and dicyclopentene may be used.

As the paraffin type hydrocarbon, a straight-chain paraffin compound such as hexane, heptane, octane, nonane, decane, undecane, dodecane, tridecane, tetradecane, pentadecane, hexadecane, heptadecane or octadecane, branched chain paraffin compound such as isohexane, isoheptane, isooctane, isohexane, isododecane, isotridecane, isotetradecane, isopentadecane, isohexadecane, isoheptadecane and isooctadecane or a cyclic paraffin compound such as cyclohexane may be used.

Examples of the aromatic hydrocarbon may include toluene, xylene and cumene.

As the terpene type compound, a monoterpene compound which is a dimer of isoprene, sesquiterpene compound which is a trimer of isoprene and diterpene compound which is a tetramer of isoprene may be used. Specific and preferable examples of the terpene compound include α-pinene, β-pinene, camphene, limonene, dipentene, terpinolene, myrcene, β-kaliophilene and cedrene and particularly limonene, dipentene or terpinolene is preferable.

In the present invention, at least one selected from, particularly, straight-chain paraffin compounds, branched chain paraffin compounds, monoterpene compounds and sesquiterpene compounds are preferable. One or more types selected from decane, undecane, dodecane, tridecane, tetradecane, pentadecane, hexadecane, isododecane, isotridecane, isotetradecane, isopentadecane, isohexadecane, isoheptadecane, isooctadecane, limonene, dipentene and terpinolene are preferable.

Component (c) used in the present invention is preferably a paraffin compound having a 50% distillation temperature of 150 to 360° C. and preferably 170 to 330° C. in a distillation test according to JIS K2254. Compounds having the distillation temperature falling in this range is not only free from odor problems but also superior in stability and also in detergent effect. Also, normal paraffin having 10 to 20 carbon atoms or isoparaffin having 10 to 20 carbon atoms is preferable and particularly isoparaffin is more preferable in view of odors. Specific examples of the paraffin compound may include normal paraffins such as Normal Paraffin SL (trademark), Normal Paraffin L (trademark), Normal Paraffin M (trademark), Normal paraffin MA(trademark) and Normal Paraffin H (trademark) manufactured by Shin-Nippon Petrochemical Co., Ltd. and N-10 (trademark), N-11 (trademark), N-12 (trademark), N-13 (trademark) and N-14 (trademark) manufactured by Nikko Petrochemical Co., Ltd. and isoparaffins such as Isosol 300 (trademark) and Isosol 400 (trademark) manufactured by Shin-Nippon Petrochemical Co., Ltd., IP Solvent 1620 (trademark), IP Solvent 2028 (trademark) and IP Solvent 2835 (trademark) manufactured by Idemitsu Petrochemical Co., Ltd. and Shellsol 70 (trademark), Shellsol 71 (trademark) and Shellsol 72 (trademark) manufactured by Shell Japan Co., Ltd.

When using Component (a3), it is preferable to use Component (b2) and to use, as Component (c), a paraffin compound having the 50% distillation temperature falling in a range from 150 to 360° C. and preferably 170 to 330° C. in the above distillation test according to JIS K 2254.

Component (c) has a nature close to that of oils and hence has higher detergency to remove oily stains than water. Therefore, in the case of washing oily stains with only Component (c), denatured oil stains can be dissolved, making it possible to remove stains easily from the surface of an object. However, a detergent using only Component (c) has the problem that Component (c) itself remains on the surface to be washed and is also disadvantageous in ways such as not being safe from fire or economy. For this, the aforementioned system using a surfactant to disperse Component (c) is considered. However, when only dispersing Component (c) by a surfactant, the properties of Component (c) change, so that the original detergency of Component (c) cannot be developed. The preferred embodiments of the present invention are significant in the point that a water type detergent composition is accomplished without damaging the property of the hydrophobic solvent as Component (c).

<Component (d)>

Component (d) used in the present invention is water and ion exchange water from which trace metal components present in water are removed, and distilled water or sterilized water treated by a hypochlorite or chlorine may also be used.

<Other Component (e)>

In the present invention, it is preferable to contain a surfactant (hereinafter referred to as Component (e)) other than Component (b) to the extent that the effect of the present invention is undisturbed. Examples of Component (e) may include anionic surfactants, cationic surfactants and amphoteric surfactants.

Examples of the anionic surfactant include alkylbenzene sulfonates, polyoxyalkylene alkyl ether sulfates, alkyl sulfates, α-olefin sulfonates, α-sulfofatty acid salts or α-sulfofatty acid lower alkyl ester salts having an alkyl or alkenyl group having 10 to 18 carbon atoms.

As the alkylbenzene sulfonate, any of those provided with an alkyl chain having an average carbon number of 8 to 16 among alkylbenzene sulfonates usually distributed in the market of surfactants for detergents may be used. For example, Neopelex F25(trademark) manufactured by Kao Corporation, Dobs102 (trademark) manufactured by Shell and the like may be used. Also, it is industrially possible to obtain the alkylbenzene sulfonate by sulfonating an alkylbenzene by using an oxidant such as chlorosulfonic acid or sulfur dioxide gas. The average carbon number of the alkyl group is preferably 10 to 14. Also, a polyoxyalkylene alkyl ether sulfate may be obtained by adding 0.5 to 5 mol (in average) of EO per molecule to a straight-chain or branched chain primary alcohol or a straight-chain secondary alcohol having 10 to 18 carbon atoms in average and then sulfurizing the resulting product by using, for example, the method described in JP-A 9-137188. The average carbon number of the alkyl group is preferably 10 to 16. The alkyl sulfate may be obtained by sulfonating a straight-chain or branched chain primary alcohol or a straight-chain secondary alcohol having 10 to 16 and preferably 10 to 14 carbon atoms by using $SO_3$ or chlorosulfonic acid, followed by neutralizing. The α-olefin sulfonate can be produced by sulfonating α-alkene having 8 to 18 carbon atoms by using SO3 and then by carrying out hydration/neutralization. The obtained α-olefin sulfonate is a mixture of a compound provided with a hydroxy group in a hydrocarbon group and a compound provided with an unsaturated bond present therein. Also, as the α-sulfofatty acid lower alkyl ester salt, those in which the number of carbons in the alkyl group is preferably 10 to 16 and methyl ester or ethyl ester is preferable from the viewpoint of detergent effect. As the salt, sodium salts, potassium salts, magnesium salts, calcium salts, alkanolamine salts or ammonium salts are preferable and sodium salts, potassium salts or magnesium salts are preferable from the viewpoint of detergent effect.

In the present invention, polyoxyethylenealkyl sulfates which have an alkyl group having 10 to 14 carbon atoms and have an EO average addition mol number of 1 to 3 and alkylbenzene sulfonates having an alkyl group having 11 to 15 carbon atoms are particularly preferable from the viewpoint of detergent effects.

The amphoteric surfactant preferably contains a compound selected from compounds represented by the following formula (4) or (5) from the viewpoint of detergent effect. Also, if a hydrophobic solvent is contained, foaming is decreased significantly and it is therefore preferable to contain the compound represented by formula (4) or (5).

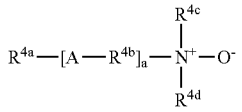

(4)

In the formula, R4a represents a straight-chain alkyl group or alkenyl group having 8 to 16 carbon atoms, preferably 10 to 16 carbon atoms and more preferably 10 to 14 carbon atoms, R4c and R4d respectively represent an alkyl group or a hydroxyalkyl group having 1 to 3 carbon atoms and preferably a methyl group, an ethyl group or a hydroxyethyl group. R4b represents an alkylene group having 1 to 5 carbon atoms and preferably 2 or 3 carbon atoms. A represents a group selected from —COO—, —CONH—, —OCO—, —NHCO— and —O— and b is a number of 0 or 1.

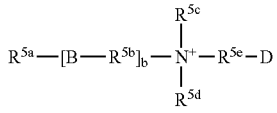

(5)

In the formula, R5a represents an alkyl group or an alkenyl group having 9 to 23, preferably 9 to 17 and more preferably 9 to 15 carbon atoms, R5b represents an alkylene group having 1 to 6 and preferably 2 or 3 carbon atoms. B represents a group selected from —COO—, —CONH—, —OCO—, —NHCO— and —O— and c is a number of 0 or 1. R5c and R5d respectively represent an alkyl group or a hydroxyalkyl group having 1 to 3 carbon atoms and R5e represents an alkylene group which has 1 to 5 and preferably 1 to 3 carbon atoms and may be substituted with a hydroxy group. D represents a group selected from —COO—, —SO3— and —OSO3—.

Compounds represented by the following formulae (6) to (8) are preferably used as the cationic surfactant from the viewpoint of detergent effect and disinfecting effect.

(6)

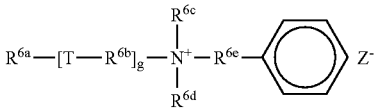

(7)

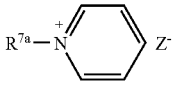

(8)

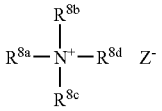

In the formula, R6a and R7a respectively represent an alkyl group or an alkenyl group having 5 to 16 and preferably 6 to 14 carbon atoms and preferably an alkyl group and R6c and R6d respectively represent an alkyl group or a hydroxyalkyl group having 1 to 3 carbon atoms. T represents —COO—, OCO—, —CONH—, —NHCO—; or

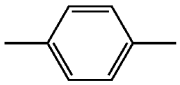

g is a number of 0 to 1. R6b represents an alkylene group having 1 to 6 carbon atoms or —(O—R6f)c-. Here, R6f represents an ethylene group or a propylene group and preferably an ethylene group and e is a number of 1 to 10 and preferably 1 to 5. R6e represents an alkylene group having 1 to 5 and preferably 2 or 3 carbon atoms. Two or more groups (preferably two groups) among R8a, R8b, R8c and R8d respectively represent an alkyl group having 8 to 12 carbon atoms and the remainder groups respectively represent an alkyl group or a hydroxyalkyl group having 1 to 3 carbon atoms. Also, $Z^-$ represents an anionic group and preferably a halogen ion or an alkylsulfuric acid ion having 1 to 3 carbon atoms.

Preferable examples of the cationic surfactant in the present invention may include the following compounds.

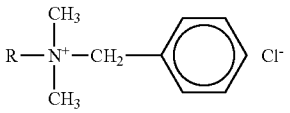

In the formula, R represents an alkyl group having 8 to 12 carbon atoms.

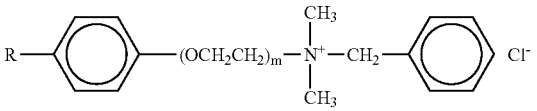

In the formula, R represents an alkyl group which may be branched and has 6 to 10 carbon atoms and m is a number from 1 to 5.

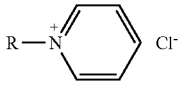

In the formula, R represents an alkyl group having 8 to 12 carbon atoms.

In the present invention, the amphoteric surfactants represented by formula (5) and cationic surfactants represented by formula (6) or (8) are preferable as Component (e).

In the present invention, it is preferable to combine a glycol type solvent (hereinafter referred to as Component (f)) for the purpose of improving detergent effect and with the view of obtaining the effect of suppressing the separation or cloudiness of the hydrophobic solvent as Component (c) at low temperatures or high temperatures. Specifically, compounds represented by the following formula (9) are preferable.

R9a-(OR9b)f-OH (9)

In the formula, R9a represents a hydrocarbon group having 1 to 7 and preferably 2 to 5 carbon atoms, f is a number from 1 to 5 and preferably 1 to 4 and R9b represents an alkylene group having 2 or 3 carbon atoms.

Specifically preferable compounds may include the following examples.

Examples include ethylene glycol monomethyl ether, ethylene glycol monoethyl ether, ethylene glycol monopropyl ether, ethylene glycol monobutyl ether, ethylene glycol monophenyl ether, ethylene glycol monobenzyl ether, diethylene glycol monomethyl ether, diethylene glycol monoethyl ether, diethylene glycol monopropyl ether, diethylene glycol monobutyl ether, diethylene glycol monohexyl ether, diethylene glycol monophenyl ether, diethylene glycol monobenzyl ether, propylene glycol monomethyl ether, propylene glycol monoethyl ether, propylene glycol monopropyl ether, propylene glycol monobutyl ether, propylene glycol monohexyl ether, dipropylene glycol monomethyl ether, dipropylene glycol monoethyl ether, dipropylene glycol monopropyl ether, dipropylene glycol monobutyl ether, polyoxypropylene (average addition mol number: 3 to 5) monomethyl ether, polyoxypropylene (average addition mol number: 3 to 5) monoethyl ether, polyoxyethylene (average addition mol number: 3 to 5) monophenyl ether and polyoxy ethylene (average addition mol number: 3 to 5) monobenzyl ether.

Particularly, diethylene glycol monobutyl ether is preferable as Component (f) in the present invention.

In the present invention, a sequestering agent (hereinafter referred to as Component (g)) is preferably contained for the purpose of further improving detergency.

Examples of the sequestering agent used in the present invention may include:

(1) phosphoric acid type compounds such as phytic acid, alkali metal salts or alkanolamine salts of these compounds;

(2) phosphonic acids such as ethane-1,1-diphosphonic acid, ethane-1,1,2-triphosphonic acid, ethane-1-hydroxy-1,1-diphosphonic acid and its derivative, ethanehydroxy-1,1,2-triphosphonic acid, ethane-1,2-dicarboxy-1,2-diphosphonic acid and methanehydroxyphosphonic acid, or alkali metal salts or alkanolamine salts of these compounds;

(3) phosphonocarboxylic acids such as 2-phosphonobutane-1,2-dicarboxylic acid, 1-phosphonobutane-2,3,4-tricarboxylic acid and α-methylphosphonosuccinic acid or alkali metal salts or alkanolamine salts of these compounds;

(4) amino acids such as aspartic acid, glutamic acid and glycine or alkali metal salts or alkanolamine salts of these compounds;

(5) aminopolyacetic acids such as nitrilotriacetic acid, iminodiacetic acid, ethylenediaminetetraacetic acid, diethylenetriaminepentaacetic acid, glycol ether diamine tetraacetic acid, hydroxyethyliminodiacetic acid, triethylenetetraminehexaacetic acid, diencolic acid, alkylglycine-N, N-diacetic acid, aspartic acid-N,N-diacetic acid, serine-N,N-diacetic acid, glutamic acid diacetic acid and ethylenediaminesuccinic acid or alkali metal salts or alkanolamine salts of these compounds;

(6) organic acids such as diglycolic acid, oxydisuccinic acid, carboxymethyloxysuccinic acid, citric acid, lactic acid, tartaric acid, oxalic acid, malic acid, oxydisuccinic acid, gluconic acid, carboxymethylsuccinic acid and carboxymethyltartaric acid or alkali metal salts or alkanolamine salts of these compounds;

(7) alkali metal salts or alkanolamine salts of aluminosilicates represented by zeolite A; and (8) aminopoly(methylenephosphonic acid) or its alkali metal salts or alkanolamine salts or polyethylenepolyaminepoly(methylenephosphonic acid) or its alkali metal salts or alkanolamine salts.

Among these compounds, at least one selected from the above (2), (5), (6) and (7) is preferable and at least one selected from the above (5) and (6) is more preferable.

In the present invention, it is preferable to contain an alkali agent (hereinafter referred to as Component (h)) from the viewpoint of detergency. Examples of the alkali agent include sodium carbonate, potassium carbonate, sodium hydroxide, potassium hydroxide, ammonia, monoethanolamine, diethanolamine, N-methylpropanol, 2-amino-2-methyl-1-propanol, N-(β-aminoethyl)ethanolamine, diethylenetriamine, morpholine and N-ethylmorpholine. Particularly, monoethanolamine, 2-amino-2-methyl-1-propanol and morpholine are good examples of the alkali agent used in the present invention.

The liquid detergent composition of the present invention has a pH of preferably 2 to 12 and more preferably 3 to 11 at 20° C. from the viewpoint of detergent effect. As a pH regulator, it is preferable to use acid agents including inorganic acids such as hydrochloric acid and sulfuric acid and organic acids such as citric acid, succinic acid, malic acid, fumaric acid, tartaric acid, malonic acid and maleic acid, and the above alkali agents either singly or in combination. It is particularly preferable to use acids selected from hydrochloric acid, sulfuric acid and citric acid and alkali agents selected from sodium hydroxide, potassium hydroxide and the above amine compounds. The composition of the present invention has a viscosity of preferably 1 to 100 mPa·s and preferably 1 to 50 mPa·s at 20° C. from the viewpoint of handling convenience. The viscosity so-meant in the present invention is measured using a B type viscometer model BM manufactured by TOKIMEC. INC after a sample is aged or maintained in a constant temperature oven at 20° C. for 30 minutes.

The liquid detergent composition of the present invention preferably contains a hydrotropic agent for the purpose of improving storage stability. Specifically preferable examples of the hydrotropic agent may include benzenesulfonic acid substituted with 1 to 3 alkyl groups having 1 to 3 carbon atoms or its salt. More specifically preferable examples of the hydrotropic agent include p-toluenesulfonic acid, m-xylenesulfonic acid, p-cumenesulfonic acid and ethylbenzenesulfonic acid. In the case of using a salt, a sodium salt, potassium salt or magnesium salt is preferable.

A polyalkylene glycol may be compounded in the composition of the present invention to prevent gelation. As specific examples of the polyalkylene glycol used to prevent gelation, polypropylene glycols and polyethylene glycols having a weight average molecular weight of 500 to 20000 which is measured by gel permeation chromatography using a polyethylene glycol as a standard are preferable.

Besides the above components, ordinary dispersants, chelating agents, perfumes, dies, pigments, antiseptics and the like may be added according to the need to the extent that the effect of the present invention is not impaired.

<Liquid Detergent Composition>

As mentioned above, it is possible to compound the hydrophobic solvent (Component (c)) stably by using the surfactant (Component (b)). However, the detergency greatly deteriorates and expected detergency may not be obtained from components (b) and (c). The present invention has reached the stage in which these problems are solved by using a specific compound "Component (a)" having one alkyl group selected from the aforementioned 2-ethylhexyl group, isononyl group and isodecyl group in order to compound Component (c) in an aqueous solution so as not to damage the properties of Component (c). Although not wanting to be limited by the theory, unlike ordinary surfactants, the compound of Component (a) enables the hydrophobic solvent to be compounded stably without deteriorating the properties of the hydrophobic solvent. Although this mechanism of action is not clarified, it is considered that unlike ordinary surfactants, Component (a) has difficulty in forming a firm micelle with a structure in which the hydrophobic solvent is confined therein because of its hydrophile lipophile balance and its branched structure and forms a continuous layer of the hydrophobic solvent, for example, a bicontinuous structure. It is interesting that the use of Component (a) makes it possible to exclude the influence of Component (b) on the hydrophobic solvent which influence is caused by the surfactant of Component (b) and moreover, the use of Component (b) in combination with Component (a) makes it possible to decrease the amount of Component (a) to be compounded, though the inventors of the present invention have found that the composition can be stabilized by using only a much amount of Component (a) without ruining the qualities of the hydrophobic solvent of Component (c). Namely Component (b) does not deteriorate the properties of Component (c) and decreases the concentration of Component (a), making it possible to retain stability and detergency. Particularly, among Component (b), a polyoxyethylene alkyl ether having a structure in which EO is added to a secondary alcohol in Component (b) or an alkyl polyglycoside having a straight-chain alkyl group is effective and is superior in stability.

It is disclosed in the publication of JP-A 6-306400 that a near three-critical point detergent composition constituted of (i) an amphoteric solvent such as triethylene glycol monohexyl ether, (ii) a non- or weak-polar solvent such as a hydrocarbon and (iii) a polar solvent such as water is used as a detergent. However, the compounds such as triethylene glycol monohexyl ether and diethylene glycol butyl ether are increased in amount to form a uniform phase and dissolved in the hydrophobic solvent, changing the properties of the hydrophobic solvent and therefore no expected effects can be obtained. Also, a liquid detergent forming a bicontinuous phase is disclosed in the publication of JP-A 2002-20791. However, the polarity of the used hydrophobic component is high and therefore sufficient detergency cannot be obtained. Also, WO01/059059 does not relate to a detergent which exhibits the high detergency of oil and a surfactant because a firm emulsion is made to stabilize the oil in the case of using the described surfactant.

Component (a) of the present invention is scarcely dissolved in both Component (c) and water and enables the hydrophobic solvent to be compounded stably in the composition without changing the properties of the hydrophobic solvent, with the result that high detergent effects can be provided.

It is surprising that if the structure of the present invention is adopted, the properties of the hydrophobic solvent are not changed and the detergent effect of both Component (f) and the hydrophobic solvent are sufficiently produced on the contrary even if an amphoteric solvent such as the above Component (f) is combined.

The ratio by mass of Component (c) to Component (d) in the present invention, that is, (c)/(d)=0.5/99.5 to 40/60, preferably 1/99 to 30/70 and more preferably 2/98 to 10/90. The sum of components (c) and (d), that is, (c)+(d) is 50 to 99 mass %, preferably 55 to 98 mass % and 65 to 98 mass %. The composition of the present invention is a liquid detergent composition containing water as a major solvent. In the liquid detergent composition of the present invention, the hydrophobic solvent which is Component (c) is dissolved stably in the solvent which is Component (d) without impairing the properties of the hydrophobic solvent and Component (a) is compounded to stabilize the composition. However, it is necessary to increase the amount of Component (a) to stabilize the composition by only using Component (a) and also the composition has only insufficient detergency. In the present invention, Component (b) is further combined to thereby decrease the amount of Component (a) to be compounded and to allow the detergency of Component (b) to be exhibited. Component (c) can be solubilized as a micelle in combination with Component (b). However, the detergency of the hydrophobic solvent which is Component (c) can be insufficiently exhibited and also the detergency of the surfactant itself is mostly deteriorated.

To state the concentration of each component in the liquid detergent composition of the present invention specifically, the concentration of Component (a) is preferably 0.1 to 30 mass %, more preferably 0.5 to 20 mass % and even more preferably 0.5 to 10 mass %, the concentration of Component (b) is preferably 0.1 to 30 mass %, more preferably 0.5 to 20 mass % and even more preferably 0.5 to 10 mass %, the concentration of Component (c) is preferably 0.1 to 30 mass %, more preferably 0.5 to 20 mass % and even more preferably 0.5 to 10 mass % and the concentration of Component (d) is preferably 30 to 98 mass %, more preferably 35 to 90 mass % and even more preferably 60 to 90 mass %.

When Component (a1) is used for the purpose of sufficiently producing the detergent effect of the hydrophobic solvent in the liquid detergent composition of the present invention, (a1) /(c) is preferably 90/10 to 40/60 (mass ratio) and more preferably 80/20 to 50/50 (mass ratio) and (a1)/(b) is preferably 90/10 to 40/60 (mass ratio) and more preferably 80/20 to 50/50 (mass ratio) for the purpose of suppressing the separation and cloudiness of the hydrophobic solvent and improving detergent effects.

When Component (a2) is used, (a2)/(c) is preferably 90/10 to 10/90 (mass ratio) and more preferably 80/20 to 50/50 (mass ratio) and (a2) /(b) is preferably 90/10 to 10/90 (mass ratio), more preferably 90/10 to 40/60 (mass ratio) and even more preferably 80/20 to 50/50 for the purpose of suppressing the separation and cloudiness of the hydrophobic solvent and improving detergent effect. However, when Component (a2) is a polyethylene glycol-mono-2-ethylhexyl ether to which 2 mol (average) of ethylene oxide is added and Component (b2) is used as Component (b), (a2)/(c) is preferably 60/40 to 10/90 and more preferably 50/50 to 20/80 and (a2)/(b2) is preferably 60/40 to 10/90 and more preferably 50/50 to 20/80.

In the case of Component (a3), the preferable compounding ratio and condition of Component (a3) are different from those of Component (a1) or (a2) because it is preferable to use Component (b2) to suppress the separation and cloudiness of the hydrophobic solvent. Namely, (a3)/(b2) is preferably 60/40 to 10/90 (mass ratio) and more preferably 50/50 to 20/80 (mass ratio) and [(a3)+(b2)]/(c) is preferably 80/20 to 50/50 and more preferably 80/20 to 60/40.

In the present invention, Component (e) is preferably contained for the purpose of improving detergent effects. The content of Component (e) in the composition is preferably 0.01 to 10 mass % and more preferably 0.05 to 8 mass %. Compounding of Component (e) in a large amount exceeding the above range sometimes causes a reduction in the detergent effect of the hydrophobic solvent and should be therefore avoided.

Component (f) in the present invention is preferably contained for the purpose of heightening detergent effects and improving stability. The content of Component (f) in the composition is preferably 1 to 20 mass % and more preferably 3 to 15 mass %.

As regards components (g) and (h) added with the view of improving detergent effects, Component (g) is contained in the composition in an amount of preferably 0.1 to 10 mass % and more preferably 1 to 8 mass % and Component (h) is contained in an amount of preferably 0.05 to 10 mass % and more preferably 0.1 to 8 mass % from the viewpoint of detergent effects.

In the present invention, other components such as a hydrotropic agent and a gelation preventive agent are properly added in consideration of the purpose of use, stability and handling convenience.

The liquid detergent composition of the present invention has high detergent effect on hydrophobic stains such as denatured oil and fats, grease and oil, can be used for industrial use and domestic use and is particularly effective for bath detergents for domestic use including detergents subjected to sebum and silicone stains in a bath and for kitchen detergents including detergents subjected to denatured stains around a range and a ventilation fan.

Preferred embodiments of the present invention will be given below.

Preferred embodiments when Component (a1) is used will be shown below.

A liquid detergent composition containing;

(a) (a1) The following compound (a-1) 0.5 to 10 mass %

(a-1)

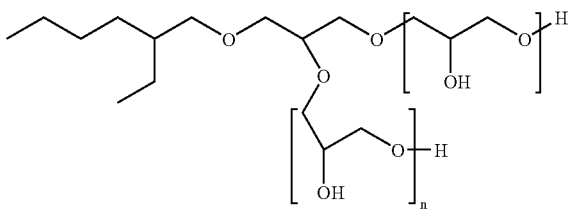

wherein m and n are respectively a number from 0 to 7 provided that m+n=1 to 3;

(b) (b1) Polyoxyethylene alkyl ether (compound having the above formula (I-1) in which R2a has 12 to 14 carbon atoms and c is 5 to 8) 0.5 to 10 mass %;

(c) Normal paraffin or isoparaffin having 10 to 20 carbon atoms 0.5 to 10 mass %;

(d) Ion exchange water 60 to 90 mass %;

(e) Amphoteric surfactant, cationic surfactant 0 to 8 mass %;

(f) Glycol type solvent 3 to 15 mass %;

(g) Sequestering agent (polyvalent carboxylic acid having a total carbon number of 4 to 20) 0 to 8 mass %;

(h) Alkali agent 0 to 8 mass %; and other components (perfumes, colorants, antiseptics and the like) 0.001 to 5 mass %, wherein (c)/(d)=2/98 to 10/90 (mass ratio) , (a1)/(c)=80/20 to 50/50 (mass ratio) (a1)/(b1)=80/20 to 50/50 (mass ratio) and (c)+(d)=65 to 98 mass %.

Preferred embodiments when Component (a2) is used will be shown below.

A liquid detergent composition containing;

(a) (a2) Polyoxyethylene (average ethylene oxide addition mol number: 4 to 6) 2-ethylhexyl ether in the case of 0.5 to 10 mass %

(b) (b1) Polyoxyethylene alkyl ether (compound having the above formula (I-1) in which R2a has 12 to 14 carbon atoms and c is 5 to 8)0.5 to 10 mass %;

(c) Normal paraffin or isoparaffin having 10 to 20 carbon atoms 0.5 to 10 mass %;

(d) Ion exchange water 60 to 90 mass %;

(e) Amphoteric surfactant, cationic surfactant 0 to 8 mass %;

(f) Glycol type solvent 3 to 15 mass %;

(g) Sequestering agent (polyvalent carboxylic acid having a total carbon number of 4 to 20) 0 to 8 mass %;

(h) Alkali agent 0 to 8 mass %; and other components (perfumes, colorants, antiseptics and the like) 0.001 to 5 mass %, wherein (c)/(d)=2/98 to 10/90 (mass ratio), (a2)/(c)=80/20 to 50/50 (mass ratio), (a2)/(b1)=80/20 to 50/50 (mass ratio) and (c)+(d)=65 to 98 mass %, or a liquid detergent composition containing;

(a) (a2) Polyoxyethylene (average ethylene oxide addition mol number: 2)2-ethylhexyl ether in the case of 5 to 10 mass %

(b) (b2) Alkylpolyglycoside (compound having the above formula (II) in which R3a has 9 to 14 carbon atoms, R3b is an ethylene group, h is 0 to 3 and i is 1 to 2) 0.5 to 10 mass %;

(c) Normal paraffin or isoparaffin having 10 to 20 carbon atoms 0.5 to 10 mass %;

(d) Ion exchange water 60 to 90 mass %;

(e) Amphoteric surfactant, cationic surfactant 0 to 8 mass %;

(f) Glycol type solvent 3 to 15 mass %;

(g) Sequestering agent (polyvalent carboxylic acid having a total carbon number of 4 to 20)0 to 8 mass %;

(h) Alkali agent 0 to 8 mass %; and other components (perfumes, colorants, antiseptics and the like) 0.001 to 5 mass %, wherein (c)/(d)=2/98 to 10/90 (mass ratio), (a2)/(c)=50/50 to 20/80 (mass ratio) (a2)/(b2)=50/50 to 20/80 (mass ratio) and (c)+(d)=65 to 98 mass %.

Also, preferred embodiments in the case of using Component (a3) will be shown below. A liquid detergent composition containing;

(a) (a3) A compound represented by the above formula (2) in which $R^1$ is 2-ethylhexyl 0.5 to 10 mass %

(b) (b2) Alkylpolyglycoside (compound having the above formula (II) in which R3a has 9 to 14 carbon atoms, R3b is an ethylene group, h is 0 to 3 and i is 1 to 2) 0.5 to 10 mass %;

(c) Normal paraffin or isoparaffin having 10 to 20 carbon atoms 0.5 to 10 mass %;

(d) Ion exchange water 60 to 90 mass %;

(e) Amphoteric surfactant, cationic surfactant 0 to 8 mass %;

(f) Glycol type solvent 3 to 15 mass %;

(g) Sequestering agent (polyvalent carboxylic acid having a total carbon number of 4 to 20) 0 to 8 mass %;

(h) Alkali agent 0 to 8 mass %; and other components (perfumes, colorants, antiseptics and the like) 0.001 to 5 mass %, wherein (c)/(d)=2/98 to 10/90 (mass ratio), [(a3)+(b2)]/(c)=80/20 to 50/50 (mass ratio), (a3)/(b2)=50/50 to 20/80 (mass ratio) and (c)+(d)=65 to 98 mass %.

According to the present invention, a liquid detergent composition for hard surfaces is obtained, the composition having high detergency to remove soap residue stains or denatured oil stains on particularly hard surfaces, being homogeneous and having high stability.

EXAMPLE 1

<Components to be Compounded> a-1:

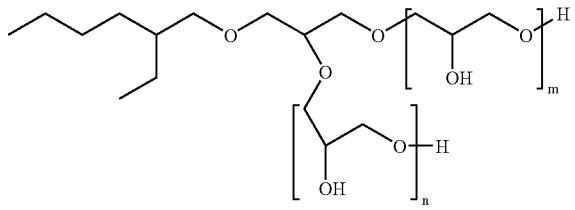

In the formula, each of m and n is a number 0 or 1 and satisfies the following equation: m+n=1. a-1 contains compounds represented by the above formula in which m and n are both 0 in an amount of 0.8 mass % based on a-1.

a-2:

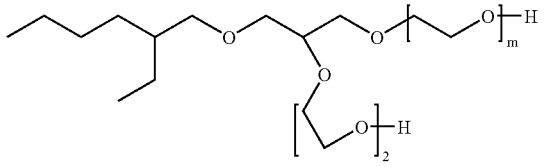

In the formula, each of m and n is a number 0 or 1 and satisfies the following equation: m+n=1. a-2 contains compounds represented by the above formula in which m and n are both 0 in an amount of 0.3 mass % based on a-2.

a-3:

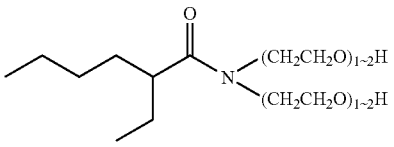

a'-1:

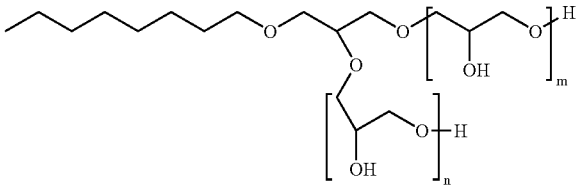

In the formula, each of m and n is a number 0 or 1 and satisfies the following equation: m+n=1. a'-1 contains compounds represented by the above formula in which m and n are both 0 in an amount of 5 mass % based on a'-1.

b-1: Softanol 70 (compound obtained by adding 7 mol (in average) of EO to a secondary alcohol having 13 carbon atoms, manufactured by Nippon Shokubai Co., Ltd.)

b-2: Polyoxyethylene lauryl ether (EO average addition mol number: 7)

b-3: Compound obtained by adding 7 mol (in average) of EO to Dovanol 23 (manufactured by Mitsubishi Chemical Co., Ltd., carbon number: 13, β-position methyl branch, content of branched chain alkyl: 20 mass %)

c-1: Dodecane (sp=16.2)

c-2: Limonene (sp=17.3)

c-3: Isosol 400 (Isoparaffin sp=15.5, manufactured by Shin-Nippon Petrochemical Co., Ltd.)

d-1: Water e-1: N-lauryl-N,N-dimethyl-N-(2-hydroxysulfopropyl)ammoniumsulfobetaine e-2: N-octyl-N,N-dimethyl-N-benzylammonium chloride f-1: Ethylene glycol monobutyl ether g-1: Citric acid h-1: Sodium hydroxide h-2: Monoethanolamine The liquid detergent compositions shown in Tables 1 and 2 were prepared to investigate the stability and detergency of each composition by the following evaluation method. The results are shown in Tables 1 and 2. In a part of the comparative products, a'-1 was regarded as Component (a) for the sake of convenience to calculate (a)/(b) and (a)/(c).

<Evaluation Method>

(1-1) Stability

○: Stable transparent solution which is free from phase separation and cloudiness even if allowed to stand at ambient temperature (10 to 30° C.) for one month or more.

×: Phase separation, cloudiness and precipitation are caused under the same condition.

(1-2) Detergency (Detergency to Remove Soap Residue Stains)

A washbowl (made of a polypropylene) to which a soap residue was firmly adhered after being actually used for three months was rubbed back and forth 5 times by using a polyurethane sponge impregnated with each liquid detergent composition with applying a load of about 500 g to the sponge. This operation was repeated 20 times and the results of the evaluation were expressed by an average of the results measured 20 times.

5: Stains are removed very efficiently.

4: Stains are removed efficiently.

3: Stains are removed unevenly.

2: Stains are removed slightly.

1: Stains are not almost removed.

(1-3) Detergency (Detergency to Remove Denatured Stains)

10 g of tempura oil was applied evenly to an iron plate and baked at 180° C. for 30 minutes. Then, the plate was further allowed to stand at ambient temperature for 3 months to form an almost dried layer, thereby preparing a model stained plate. About 0.5 mL of each liquid detergent composition was dripped on the model stained plate secured horizontally and allowed to stand for one minute. Then, the floated stain was lightly removed by absorbent cotton. This operation was repeated 20 times and the degree of cleaning was observed visually each time to evaluate according to the following standard. The results of evaluation were expressed by an average of the results measured 20 times.

5: Soils are removed substantially perfectly.

4: About 60% to 80% of soils is removed.

3: About 50% to 60% of soils is removed.

2: About 30% to 50% of soils is removed.

1: About 30% or less of soils is removed.

0: Soils are not removed at all.

TABLE 1

| | | | | Example of the invention | | | | | Comparative product | | | |
|---|---|---|---|---|---|---|---|---|---|---|---|---|
| | | | | 1-1 | 1-2 | 1-3 | 1-4 | 1-5 | 1-1 | 1-2 | 1-3 | 1-4 |
| Liquid detergent composition | Component (mass %) | (a) | a-1 | 2 | 3.5 | 10 | 7 | 20 | 2 | | | 15 |
| | | (b) | b-1 | 2 | 1.5 | | | | 2 | | | |
| | | | b-2 | | | 3 | | 15 | | 10 | | |
| | | | b-3 | | | | 1 | | | | | |
| | | (c) | c-1 | 2 | | | | | | 2 | | |
| | | | c-2 | | 2 | | | | | | | |

TABLE 1-continued

| | | Example of the invention | | | | | Comparative product | | | |
|---|---|---|---|---|---|---|---|---|---|---|
| | | 1-1 | 1-2 | 1-3 | 1-4 | 1-5 | 1-1 | 1-2 | 1-3 | 1-4 |
| | c-3 | | | 5 | 2 | 20 | | | 2 | |
| (d) | d-1 | 74.7 | 73.5 | 60.5 | 67.5 | 36.5 | 76.7 | 68.7 | 82.0 | 65.5 |
| (e) | e-1 | 3 | 3 | 4 | 3 | 1 | 3 | 3 | 2 | 3 |
| | e-2 | 0.8 | 1 | 0.5 | 1 | 0.5 | 0.8 | 0.8 | 0.5 | 1 |
| (f) | f-1 | 8 | 8 | 11 | 11 | 2 | 8 | 8 | 6 | 8 |
| (g) | g-1 | 5 | 5 | 4 | 5 | 3 | 5 | 5 | 5 | 5 |
| (h) | h-1 | 2.5 | 2.5 | 2 | 2.5 | 2 | 2.5 | 2.5 | 2.5 | 2.5 |
| | Total | 100 | 100 | 100 | 100 | 100 | 100 | 100 | 100 | 100 |
| | pH (20° C.) | 7 | 7 | 7 | 7 | 7 | 7 | 7 | 7 | 7 |
| | (c)/(d) (mass ratio) | 2/74.7 | 2/73.5 | 5/60.5 | 2/67.5 | 20/36.5 | 0/76.7 | 2/68.7 | 2/82 | 0/65.5 |
| | (c) + (d) (mass %) | 76.7 | 75.5 | 65.5 | 69.5 | 56.5 | 76.7 | 70.7 | 84 | 65.5 |
| | (a)/(b) (mass ratio) | 50/50 | 70/30 | 77/23 | 88/12 | 57/43 | 50/50 | 0/100 | — | 100/0 |
| | (a)/(c) (mass ratio) | 50/50 | 64/36 | 67/33 | 78/22 | 50/50 | 100/0 | 0/100 | 0/100 | 100/0 |
| Stability | | ○ | ○ | ○ | ○ | ○ | ○ | ○ | X | X |
| Detergency to soap residue stains | | 4.0 | 4.3 | 4.7 | 4.4 | 4.8 | 1.5 | 2.1 | 1.2 | 1.2 |

TABLE 2

| | | | Example of the invention | | | | | | Comparative product |
|---|---|---|---|---|---|---|---|---|---|
| | | | 2-1 | 2-2 | 2-3 | 2-4 | 2-5 | 2-6 | 2-1 |
| Liquid detergent composition | Component (mass %) | (a) a-1 | 2 | 3.5 | 3.5 | 10 | 7 | 20 | |
| | | a'-1 | | | | | | | 10 |
| | | (b) b-1 | 2 | | 1.5 | | 1 | 15 | 5 |
| | | b-2 | | 1.5 | | | | | |
| | | b-3 | | | | 3 | | | |
| | | (c) c-1 | 2 | 2 | | | | 20 | |
| | | c-2 | | | 2 | | | | |
| | | c-3 | | | | 5 | 2 | | 5 |
| | | (d) d-1 | 82.5 | 81.5 | 84.5 | 70.5 | 75.5 | 40.5 | 67.5 |
| | | (e) e-1 | 3 | 3 | | | 3 | 1 | 4 |
| | | (f) f-1 | 8 | 8 | 8 | 11 | 11 | 3 | 8 |
| | | (h) h-2 | 0.5 | 0.5 | 0.5 | 0.5 | 0.5 | 0.5 | 0.5 |
| | | Total | 100 | 100 | 100 | 100 | 100 | 100 | 100 |
| | | pH (20° C.) | 10.8 | 10.8 | 10.8 | 10.8 | 10.8 | 10.8 | 10.8 |
| | | (c)/(d) (mass ratio) | 2/82.5 | 2/81.5 | 2/84.5 | 5/70.5 | 2/75.5 | 20/40.5 | 5/67.5 |
| | | (c) + (d) (mass %) | 84.5 | 83.5 | 86.5 | 75.5 | 77.5 | 60.5 | 72.5 |
| | | (a)/(b) (mass ratio) | 50/50 | 70/30 | 70/30 | 77/23 | 88/12 | 57/43 | 67/33 |
| | | (a)/(c) (mass ratio) | 50/50 | 64/36 | 64/36 | 67/33 | 78/22 | 50/50 | 67/33 |
| Stability | | | ○ | ○ | ○ | ○ | ○ | ○ | X |
| Detergency to soap residue stains | | | 4.2 | 4.0 | 4.0 | 4.4 | 4.1 | 4.9 | 1.8 |

Also, formulation examples of the liquid detergent composition of the present invention are shown in Table 3. The formulation examples 3-1 to 3-4 are preferably used to wash soap residue stains and the formulation examples 3-5 and 3-6 are preferably used to wash oil stains.

TABLE 3

| | | | | Formulation example | | | | | |
|---|---|---|---|---|---|---|---|---|---|
| | | | | 3-1 | 3-2 | 3-3 | 3-4 | 3-5 | 3-6 |
| Liquid detergent composition | Component (mass %) | (a) | a-1 | 3.5 | | | | | |
| | | | a-2 | | 3.5 | | 2 | 10 | 3.5 |
| | | | a-3 | | | 10 | | | |
| | | (b) | b-1 | | | 5 | | 5 | |
| | | | b-2 | 1.5 | | | 3 | | |
| | | | b-3 | | 1.5 | | | | 1.5 |
| | | (c) | c-1 | 2 | | | 2 | | |
| | | | c-2 | | | 3 | | 4 | 2 |
| | | | c-3 | | 2 | | | | |
| | | (d) | d-1 | 73.7 | 73.7 | 60.5 | 73.7 | 65.5 | 84.5 |
| | | (e) | e-1 | 8 | 8 | 4 | 8 | 4 | |
| | | (f) | f-1 | 3 | 3 | 0.5 | 3 | 11 | 8 |
| | | | f-2 | 0.8 | 0.8 | 11 | 0.8 | | |
| | | (g) | g-1 | 5 | 5 | 4 | 5 | | |
| | | (h) | h-1 | 2.5 | 2.5 | 2 | 2.5 | | |
| | | | h-2 | | | | | 0.5 | 0.5 |
| | | | Total | 100 | 100 | 100 | 100 | 100 | 100 |
| | pH(20° C.) | | | 7 | 7 | 7 | 7 | 10.8 | 10.8 |

EXAMPLE 2

<Components to be Compounded>

2a-1: Compound obtained by adding 4 mol (in average) of EO to 2-ethyl-1-hexanol 2a-2: Compound obtained by adding 5 mol (in average) of EO to 3,5,5-trimethyl-1-hexanol 2a-3: Compound obtained by adding 3 mol (in average) of EO to isodecanol 2a'-1: Compound obtained by adding 4 mol (in average) of EO to octanol 2b-1: Softanol 70 (compound obtained by adding 7 mol (in average) of EO to a secondary alcohol having 13 carbon atoms, manufactured by Nippon Shokubai Co., Ltd.)

2b-2: Alkylpolyglycoside (alkyl group having 12 carbon atoms, glucose average degree of condensation: 1.3)

2b-3: Polyoxyethylene lauryl ether (Eo average addition mol number: 6)

2b-4: Compound obtained by adding 6 mol (in average) of EO to Dovanol 23 (manufactured by Mitsubishi Chemical Co., Ltd., carbon number: 13, β-position methyl branch, content of branched chain alkyl: 20 mass %)

2c-1: Dodecane (sp=16.2)

2c-2: Limonene (sp=17.3)

2c-3: IP2028 (Isoparaffin sp=14.3, manufactured by Idemitsu Petrochemical Co., Ltd.)

2d-1: Water 2c-1: Diethylene glycol monobutyl ether 2f-1: N-lauryl-N,N-dimethyl-N-(2-hydroxysulfopropyl)ammoniumsulfobetaine 2f-2: N-octyl-N,N-dimethyl-N-benzylammonium chloride 2g-1: Citric acid 2h-1: Sodium hydroxide 2h-2: Monoethanolamine The liquid detergent compositions shown in Tables 4 to 8 were prepared to investigate the stability and detergency of each composition by the following evaluation method. The results are shown in Tables 4 to 8. In a part of the comparative products, 2a'-1 was regarded as Component (a) for the sake of convenience to calculate (a) (b) and (a) (c).

TABLE 4

| | | | | Example of the invention | | | | |
|---|---|---|---|---|---|---|---|---|
| | | | | 21-1 | 21-2 | 21-3 | 21-4 | 21-5 |
| Liquid detergent composition | component (mass %) | (a) | 2a-1 | 2 | 3.5 | 2 | 10 | 20 |
| | | (b) | 2b-1 | 2 | 1.5 | | | |
| | | | 2b-2 | | | 2 | 3 | 15 |
| | | (c) | 2c-1 | 2 | 2 | | | |
| | | | 2c-2 | | | | | 20 |
| | | | 2c-3 | | | 2 | 5 | |
| | | (d) | 2d-1 | 75 | 73.5 | 75.7 | 58.7 | 36.5 |
| | | (e) | 2e-1 | 8 | 8 | 7 | 11 | 3 |

TABLE 4-continued

| | | | Example of the invention | | | | |
|---|---|---|---|---|---|---|---|
| | | | 21-1 | 21-2 | 21-3 | 21-4 | 21-5 |
| | | (f) 2f-1 | 3 | 3 | 3 | 4 | 5 |
| | | 2f-2 | 0.5 | 1 | 0.8 | 0.8 | 0.5 |
| | | (g) 2g-1 | 5 | 5 | 5 | 5 | |
| | | (h) 2h-1 | 2.5 | 2.5 | 2.5 | 2.5 | |
| | | Total | 100 | 100 | 100 | 100 | 100 |
| | pH (20° C.) | | 7 | 7 | 7 | 7 | 7 |
| | (c)/(d) (mass ratio) | | 2/75 | 2/73.5 | 2/75.7 | 5/58.7 | 20/36.5 |
| | (c) + (d) (mass %) | | 77 | 75.5 | 77.7 | 63.7 | 56.5 |
| | (a)/(b) (mass ratio) | | 50/50 | 70/30 | 50/50 | 77/23 | 20/15 |
| | (a)/(c) (mass ratio) | | 50/50 | 64/36 | 50/50 | 67/33 | 50/50 |
| Stability | | | ○ | ○ | ○ | ○ | ○ |
| Detergency to soap residue stains | | | 4.1 | 4.2 | 4.2 | 4.6 | 4.9 |

TABLE 5

| | | | Comparative product | | | | |
|---|---|---|---|---|---|---|---|
| | | | 21-1 | 21-2 | 21-3 | 21-4 | 21-5 |
| Liquid detergent composition | Component (mass %) | (a) 2a-1 | 2 | | | 10 | 1 |
| | | (b) 2b-1 | 2 | | | | 1 |
| | | 2b-2 | | 10 | | | |
| | | (c) 2c-1 | | 2 | | | |
| | | 2c-2 | | | 0.5 | | 0.05 |
| | | (d) 2d-1 | 78 | 70 | 83.2 | 73.7 | 81.65 |
| | | (e) 2e-1 | 7 | 7 | 5 | 5 | 7 |
| | | (f) 2f-1 | 0.5 | 0.5 | 0.8 | 0.8 | 0.8 |
| | | 2f-2 | 3 | 3 | 3 | 3 | 1 |
| | | (g) 2g-1 | 5 | 5 | 5 | 5 | 5 |
| | | (h) 2h-1 | 2.5 | 2.5 | 2.5 | 2.5 | 2.5 |
| | | Total | 100 | 100 | 100 | 100 | 100 |
| | pH (20° C.) | | 7 | 7 | 7 | 7 | 7 |
| | (c)/(d) (mass ratio) | | 0/78 | 2/70 | 0.5/83.2 | 0/73.7 | 0.05/81.65 |
| | (c) + (d) (mass %) | | 78 | 72 | 83.7 | 73.7 | 81.7 |
| | (a)/(b) (mass ratio) | | 50/50 | 0/100 | — | 100/0 | 50/50 |
| | (a)/(c) (mass ratio) | | 100/0 | 0/100 | 0/100 | 100/0 | 95/5 |
| Stability | | | ○ | ○ | X | X | ○ |
| Detergency to soap residue stains | | | 1.4 | 1.9 | 1.3 | 1.3 | 1.5 |

TABLE 6

| | | | Example of the invention | | | |
|---|---|---|---|---|---|---|
| | | | 22-1 | 22-2 | 22-3 | 22-4 |
| Liquid detergent composition | Component (mass %) | (a) 2a-1 | 2 | 3.5 | 10 | 20 |
| | | (b) 2b-1 | 2 | | | |
| | | 2b-2 | | | 3 | 15 |
| | | 2b-3 | | 1.5 | | |
| | | (c) 2c-1 | 2 | 2 | | |
| | | 2c-2 | | | | 20 |
| | | 2c-3 | | | 5 | |
| | | (d) 2d-1 | 86.5 | 92.5 | 73.5 | 37.5 |
| | | (e) 2e-1 | 7 | | 8 | 7 |
| | | (h) 2h-2 | 0.5 | 0.5 | 0.5 | 0.5 |
| | | Total | 100 | 100 | 100 | 100 |
| | pH (20° C.) | | 10.8 | 10.8 | 10.8 | 10.8 |
| | (c)/(d) (mass ratio) | | 2/86.5 | 2/92.5 | 5/73.5 | 20/37.5 |
| | (c) + (d) (mass %) | | 88.6 | 94.5 | 78.5 | 57.5 |
| | (a)/(b) (mass ratio) | | 50/50 | 70/30 | 77/23 | 57/43 |
| | (a)/(c) (mass ratio) | | 50/50 | 64/36 | 67/33 | 50/50 |

TABLE 6-continued

| | Example of the invention | | | |
|---|---|---|---|---|
| | 22-1 | 22-2 | 22-3 | 22-4 |
| Stability | ○ | ○ | ○ | ○ |
| Detergency to oil stains | 4.1 | 4 | 4.4 | 4.8 |

TABLE 7

| | | | | Comparative product | |
|---|---|---|---|---|---|
| | | | | 22-1 | 22-2 |
| Liquid detergent composition | Component (mass %) | (a) | 2a-3 | 20 | |
| | | | 2a'-1 | | 10 |
| | | (b) | 2b-1 | | 5 |
| | | (c) | 2c-1 | 10 | |
| | | | 2c-3 | | 5 |
| | | (d) | 2d-1 | 64.5 | 71.5 |
| | | (e) | 2e-1 | 5 | 8 |
| | | (h) | 2h-2 | 0.5 | 0.5 |
| | | | Total | 100 | 100 |
| | pH (20° C.) | | | 10.8 | 10.8 |
| | (c)/(d) (mass ratio) | | | 10/64.5 | 5/71.5 |
| | (c) + (d) (mass %) | | | 74.5 | 76.5 |
| | (a)/(b) (mass ratio) | | | 100/0 | 67/33 |
| | (a)/(c) (mass ratio) | | | 67/33 | 67/33 |
| Stability | | | | X | X |
| Detergency to oil stains | | | | 1.5 | 1.7 |

Also, formulation examples of the liquid detergent composition of the present invention are shown in Table 8. The formulation examples 23-1 to 23-5 are preferably used to wash soap residue stains and the formulation examples 23-6 and 23-8 are preferably used to wash oil stains.

EXAMPLE 3

<Components to be Compounded>

3a-1: Compound obtained by adding 1 mol of glycidol to 2-ethyl-1-hexanol, followed by refining by distillation.

3a-2: Compound obtained by adding glycidol to isodecanol in the same manner as in the case of 3a-1, followed by refining by distillation.

3a-3: Compound obtained by adding glycidol to 3,5,5-trimethyl-1-hexanol in the same manner as in the case of 3a-1, followed by refining by distillation.

3a'-1: Compound obtained by adding glycidol to 1-octanol, followed by refining by distillation.

3b-1: Alkylpolyglycoside (alkyl group having 12 carbon atoms, glucose average degree of condensation: 1.3)

3b'-1: Polyoxyethylene lauryl ether (EO average addition mol number: 7)

3c-1: IP solvent 2028 (trademark: Idemitsu Petrochemical Co., Ltd., 50% distilled temperature in a distillation test (JIS K 2254): 233° C.)

3c-2: Normal paraffin L (trademark: Idemitsu Petrochemical Co., Ltd., 50% distilled temperature in a distillation test (JIS K 2254): 206° C.)

3c'-1: IP solvent 1016 (trademark: Idemitsu Petrochemical Co., Ltd., 50% distilled temperature in a distillation test (JIS K 2254): 110° C.)

3c-1: N-lauryl-N,N-dimethyl-N-(2-hydroxysulfopropyl)ammoniumsulfobetaine 3e-2: N-octyl-N,N-dimethyl-N-benzylammonium chloride 3f-1: Diethylene glycol monobutyl ether 3g-1: Citric acid

TABLE 8

| | | | | Formulation example | | | | | | | |
|---|---|---|---|---|---|---|---|---|---|---|---|
| | | | | 23-1 | 23-2 | 23-3 | 23-4 | 23-5 | 23-6 | 23-7 | 23-8 |
| Liquid detergent composition | Component (mass %) | (a) | 2a-1 | 3.5 | 3.5 | | | | | | 10 |
| | | | 2a-2 | | | 10 | 3.5 | | 3.5 | 10 | |
| | | | 2a-3 | | | | | 7 | | | |
| | | (b) | 2b-1 | | | | | 1 | | | |
| | | | 2b-2 | | | 10 | | | | 10 | 10 |
| | | | 2b-3 | 1.5 | | | | | | | |
| | | | 2b-4 | | 1.5 | | 1.5 | | 1.5 | | |
| | | (c) | 2c-1 | 2 | 2 | | 2 | 2 | 2 | | |
| | | | 2c-3 | | | 10 | | | | 10 | 10 |
| | | (d) | 2d-1 | 73.7 | 73.7 | 48.7 | 73.7 | 67.7 | 85.5 | 61.5 | 61.5 |
| | | (e) | 2e-1 | 8 | 8 | 11 | 8 | 11 | 7 | 8 | 8 |
| | | (f) | 2f-1 | 3 | 3 | 2 | 3 | 3 | | | |
| | | | 2f-2 | 0.8 | 0.8 | 0.8 | 0.8 | 0.8 | | | |
| | | (g) | 2g-1 | 5 | 5 | 5 | 5 | 5 | | | |
| | | (h) | 2h-1 | 2.5 | 2.5 | 2.5 | 2.5 | 2.5 | | | |
| | | | 2h-2 | | | | | | 0.5 | 0.5 | 0.5 |
| | | | Total | 100 | 100 | 100 | 100 | 100 | 100 | 100 | 100 |
| | pH (20° C.) | | | 7 | 7 | 7 | 7 | 7 | 10.8 | 10.8 | 10.8 |

The liquid detergent compositions shown in Tables 9 and 10 were prepared to investigate the odors, stability and detergency of each composition by the following evaluation methods. The results are shown in Tables 9 and 10. In a part of the comparative products, 3a'-1 was regarded as Component (a), 3b'-1 was regarded as Component (b) and 3c'-1 was regarded as Component (c),for the sake of convenience to calculate (a)/(b) and (a)/(c).

<Methods of Evaluation>

(1-1) Odors

○: No paraffin odor is emitted.

×: Paraffin odor is emitted.

(1-2) Stability

○: A composition is free from phase separation and cloudiness and is present as a stable transparent solution even if it is allowed to stand at ambient temperature (10 to 30° C.) for one month.

×: Phase separation, cloudiness and precipitation are caused under the same condition.

TABLE 9

| | | | | Example of the present invention | | | | | | Comparative product | | |
|---|---|---|---|---|---|---|---|---|---|---|---|---|
| | | | | 31-1 | 31-2 | 31-3 | 31-4 | 31-5 | 31-6 | 31-1 | 31-2 | 31-3 |
| Liquid detergent composition | Component (mass %) | (a) | 3a-1 | 0.75 | 2.5 | 1 | 1.2 | 5 | 5 | | | 5 |
| | | (b) | 3b-1 | 1.9 | 6 | 3 | 4.8 | 8 | 12.5 | | 10 | |
| | | (c) | 3c-1 | 2 | 5 | | | | 8 | | 2 | |
| | | | 3c-2 | | | 2 | 2 | 5 | | 0.5 | | |
| | | (d) | 3d-1 | 78.75 | 69.9 | 77.4 | 75.4 | 65.4 | 54.9 | 82.9 | 71.4 | 78.4 |
| | | (e) | 3e-1 | 3 | 3 | 3 | 3 | 3 | 3 | 3 | 3 | 3 |
| | | | 3e-2 | 1 | 1 | 1 | 1 | 1 | 1 | 1 | 1 | 1 |
| | | (f) | 3f-1 | 5 | 5 | 5 | 5 | 5 | 8 | 5 | 5 | 5 |
| | | (g) | 3g-1 | 5 | 5 | 5 | 5 | 5 | 5 | 5 | 5 | 5 |
| | | (h) | 3h-1 | 2.6 | 2.6 | 2.6 | 2.6 | 2.6 | 2.6 | 2.6 | 2.6 | 2.6 |
| | | | Total | 100 | 100 | 100 | 100 | 100 | 100 | 100 | 100 | 100 |
| | pH (20° C.) | | | 8 | 8 | 8 | 8 | 8 | 8 | 8 | 8 | 8 |
| | (c)/(d) (mass ratio) | | | 2.48/97.52 | 6.7/93.3 | 2.5/97.5 | 2.6/97.4 | 7.1/93.9 | 12.7/87.3 | 0.6/99.4 | 2.7/97.3 | 0/100 |
| | (c) + (d) (mass %) | | | 80.8 | 74.9 | 79.4 | 77.4 | 70.4 | 62.9 | 83.4 | 73.4 | 78.4 |
| | (a)/(b) (mass ratio) | | | 28.3/71.7 | 29.4/71.6 | 25/75 | 20/80 | 38.5/61.5 | 28.6/71.4 | 0/0 | 0/100 | 100/0 |
| | [(a) + (b)]/(c) (mass ratio) | | | 56.99/43.01 | 63/37 | 66.7/33.3 | 75/25 | 72.2/27.8 | 68.6/31.4 | 0/100 | 83.3/16.7 | 100/0 |
| Odor | | | | ○ | ○ | ○ | ○ | ○ | ○ | ○ | ○ | ○ |
| Stability | | | | ○ | ○ | ○ | ○ | ○ | ○ | X | X | X |
| Detergency to soap residue stains | | | | 4.3 | 4.6 | 4.3 | 4.1 | 4.5 | 4.8 | 1.3 | 1.9 | 1.0 |

TABLE 10

| | | | | Example of the present invention | | | | | Comparative product |
|---|---|---|---|---|---|---|---|---|---|
| | | | | 32-1 | 32-2 | 32-3 | 32-4 | 32-5 | 32-1 |
| Liquid detergent composition | Component (mass %) | (a) | 3a-1 | 0.75 | 2.5 | 1 | 1.2 | 5 | 1 |
| | | | 3a'-1 | | | | | | |
| | | (b) | 3b-1 | 1.9 | 6 | 3 | 4.8 | 8 | |
| | | | 3b'-1 | | | | | | 3 |
| | | (c) | 3c-1 | 2 | 5 | | | | |
| | | | 3c-2 | | | 2 | 2 | 5 | 2 |
| | | | 3c'-1 | | | | | | |
| | | (d) | 3d-1 | 94.85 | 86 | 93.5 | 91.5 | 81.5 | 93.5 |
| | | (h) | 3h-2 | 0.5 | 0.5 | 0.5 | 0.5 | 0.5 | 0.5 |
| | | | Total | 100 | 100 | 100 | 100 | 100 | 100 |
| | pH (20° C.) | | | 11 | 11 | 11 | 11 | 11 | 11 |
| | (c)/(d) (mass ratio) | | | 2.07/97.93 | 5.5/94.5 | 2.1/97.9 | 2.1/97.9 | 5.8/94.2 | 2.1/97.9 |
| | (c) + (d) (mass %) | | | 96.85 | 91 | 95.5 | 93.5 | 86.5 | 95.5 |
| | (a)/(b) (mass ratio) | | | 28.3/71.7 | 29.4/70.6 | 25/75 | 20/80 | 38.5/61.5 | 25/75 |
| | [(a) + (b)]/(c) (mass ratio) | | | 56.99/43.01 | 63/37 | 66.7/33.3 | 75/25 | 72.2/27.8 | 66.7/33.3 |
| Intensity of odors | | | | ○ | ○ | ○ | ○ | ○ | ○ |
| Stability | | | | ○ | ○ | ○ | ○ | ○ | X |
| Detergency to denaturated oil stains | | | | 4.5 | 4.7 | 4.3 | 4.3 | 4.6 | 1.4 |

| | | | | Comparative product | | | | | |
|---|---|---|---|---|---|---|---|---|---|
| | | | | 32-2 | 32-3 | 32-4 | 32-5 | 32-6 | 32-7 |
| Liquid detergent composition | Component (mass %) | (a) | 3a-1 | | | 7.5 | 2.5 | 1.1 | 4 |
| | | | 3a'-1 | 1 | | | | | |
| | | (b) | 3b-1 | 3 | 25 | 18 | 6 | 2.9 | 10 |
| | | | 3b'-1 | | | | | | |

TABLE 10-continued

| | | | | | | | |
|---|---|---|---|---|---|---|---|
| | (c) 3c-1 | | | | | 5 | 2 |
| | 3c-2 | 2 | 2 | 15 | | | |
| | 3c'-1 | | | | 5 | | |
| | (d) 3d-1 | 93.5 | 72.5 | 59 | 90 | 88.5 | 80.5 |
| | (h) 3h-2 | 0.5 | 0.5 | 0.5 | 1.5 | 2.5 | 3.5 |
| | Total | 100 | 100 | 100 | 100 | 100 | 100 |
| | pH (20° C.) | 11 | 11 | 11 | 12 | 13 | 14 |
| | (c)/(d) (mass ratio) | 2.1/97.9 | 2.7/97.3 | 20.3/79.7 | 5.3/94.7 | 5.35/94.65 | 2.42/97.58 |
| | (c) + (d) (mass %) | 95.5 | 74.5 | 74 | 95 | 93.5 | 82.5 |
| | (a)/(b) (mass ratio) | 25/75 | 0/100 | 29.4/70.6 | 29.4/70.6 | 27.5/72.5 | 28.6/71.4 |
| | [(a) + (b)]/(c) (mass ratio) | 66.7/33.3 | 92.6/7.4 | 63/37 | 63/37 | 44.4/55.6 | 87.5/12.5 |
| Intensity of odors | | ○ | ○ | X | X | ○ | ○ |
| Stability | | X | ○ | ○ | ○ | X | X |
| Detergency to denaturated oil stains | | 1.2 | 1.0 | 4.9 | 3.8 | 1.5 | 1.2 |

EXAMPLE 4

Formulation examples of the liquid detergent composition of the present invention are shown in Table 11.

TABLE 11

| | | | Formulation example | | | |
|---|---|---|---|---|---|---|
| | | | 33-1 | 33-2 | 33-3 | 33-4 |
| Liquid detergent composition | Componenet (mass %) | (a) 3a-1 | 1 | | | |
| | | 3a-2 | | 1 | | 2.5 |
| | | 3a-3 | | | 2.5 | |
| | | (b) 3b-1 | 3 | 3 | 6 | 6 |
| | | (c) 3c-1 | 2 | 2 | | 5 |
| | | 3c-2 | | | 5 | |
| | | (d) 3d-1 | 77.4 | 77.4 | 69.9 | 86 |
| | | (e) 3e-1 | 3 | 3 | 3 | |
| | | 3e-2 | 1 | 1 | 1 | |
| | | (f) 3f-1 | 5 | 5 | 5 | |
| | | (g) 3g-1 | 5 | 5 | 5 | |
| | | (h) 3h-1 | 2.6 | 2.6 | 2.6 | |
| | | 3h-2 | | | | 0.5 |
| | Total | | 100 | 100 | 100 | 100 |
| | pH(20° C.) | | 8 | 8 | 8 | 8 |
| | (c)/(d)(mass ratio) | | 2.5/97.5 | 2.5/97.5 | 6.7/93.3 | 5.5/94.5 |
| | (c) + (d)(mass %) | | 79.4 | 79.4 | 74.9 | 91.0 |
| | (a)/(b)(mass ratio) | | 25/75 | 25/75 | 29.4/70.6 | 29.4/70.6 |
| | [(a) + (b)]/(c)(mass ratio) | | 66.7/33.3 | 66.7/33.3 | 63/37 | 63/37 |

The invention claimed is:

1. A liquid detergent composition comprising (a) a nonionic compound having one alkyl group selected from a 2-ethylhexyl group, an isononyl group and an isodecyl group, the alkyl group being connected with an organic group having 1 to 10 hydroxyl groups and 3 to 30 carbon atoms through an ether bond, an ester bond, an amide bond or a nitrogen atom, (b) a nonionic surfactant having an alkyl or alkenyl group having 11 to 16 carbon atoms, (c) a hydrophobic organic solvent which is liquid at 20° C. and (d) water, wherein (c)/(d)=0.5/99.5 to 40/60 (mass ratio) and (c)+(d) =50 to 99 (mass %).

2. The liquid detergent composition according to claim 1, wherein Component (a) is a compound (al) represented by formula (1):

$$R1—T—[S]m \quad (1)$$

wherein R1 represents an alkyl group selected from a 2-ethylhexyl group, an isononyl group and an isodecyl group and T represents a group selected from —O—, —COO—, —OCO—, —CON<and —N<, provided that when T is —O—, —COO— or —OCO—, m is 1 whereas when T is;

—CON< or —N<, m is 2, S represents a group having 1 to 10 hydroxyl groups and a total carbon number of 4 to 30, provided that when the number of hydroxyl groups in S is 1, m is 2 whereas when the number of hydroxyl groups in S is 2, at least one group is a hydroxy group bonded with an oxyethylene group or a polyoxyethylene group having an average addition mol number of 5 or less and exceeding 1.

3. The liquid detergent composition according to claim 1, wherein Component (a) is a polyoxyalkylene alkyl ether (a2) which has one alkyl group selected from a 2-ethylhexyl group, an isononyl group and an isodecyl group and in which the average addition mol number of alkylene oxides having 2 or 3 carbon atoms is 2 to 6.

4. The liquid detergent composition according to claim 1, wherein Component (b) is an alkylpolyglycoside surfactant (b2) represented by the following formula (II):

$$R^{2a}—(OR^{2b})\ aGb \quad (II)$$

wherein $R^{2a}$ represents an alkyl group having 11 to 16 carbon atoms, R2b represents an alkylene group having 2 to 4 carbon atoms, G represents a residue derived from a reducing sugar, a is an average number of 0 to 6 and b is an average number of 1 to 3.

5. The liquid detergent composition according to claim 4, wherein Component (a) is a compound (a3) represented by the following formula (2):

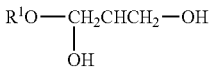

(2)

wherein R1 represents one alkyl group selected from 2-ethylhexyl, an isodecyl and an isononyl group.

6. The liquid detergent composition according to claim 1, wherein Component (c) is a paraffin compound having a 50% distillation temperature of 150 to 360° C. in a distillation test according to JIS K2254.

7. The liquid detergent composition according to claim 2, wherein (a1)/(b)=90/10 to 40/60 (mass ratio) and (a1)/(c)=90/10 to 40/60 (mass ratio).

8. The liquid detergent composition according to claim 3, wherein (a2)/(b)=90/10 to 10/90 (mass ratio) and (a2)/(c)=90/10 to 10/90 (mass ratio).

9. The liquid detergent composition according to claim 5, wherein (a3)/(b2)=60/40 to 10/90 (mass ratio) and [(a3)+(b2)]/(c)=80/20 to 50/50 (mass ratio).

* * * * *